US005863394A

United States Patent [19]

Schmitt et al.

[11] Patent Number: 5,863,394

[45] Date of Patent: Jan. 26, 1999

[54] APPARATUS FOR ELECTRODEPOSITION

[75] Inventors: Peter J. Schmitt, Ontario; Patricia Bischoping, Webster; Robert P. Altavela, Farmington; Lawrence Kotowicz, Rochester; William G. Herbert, Williamson, all of N.Y.; Ronald E. Jansen, Palm City, Fla.; John H. Lennon, Canandaigua, N.Y.; Henry G. Grey, Las Vegas, Nev.

[73] Assignee: Xerox Corporation, Stamford, Conn.

[21] Appl. No.: 733,241

[22] Filed: Oct. 2, 1996

(Under 37 CFR 1.47)

[51] Int. Cl.[6] ..... C25D 17/00

[52] U.S. Cl. ..... 204/198; 204/199; 204/212

[58] Field of Search ..... 204/225, 224 R, 204/198, 199, 212, 202, 280, DIG. 7

[56] References Cited

U.S. PATENT DOCUMENTS

| | | | |
|---|---|---|---|
| 1,545,383 | 4/1925 | Ashcroft | 204/24.4 |
| 3,256,165 | 6/1966 | Williams | 204/280 X |
| 3,844,906 | 10/1974 | Bailey et al. | 204/9 |
| 4,319,977 | 3/1982 | Wortley | 204/280 |
| 4,401,530 | 8/1983 | Clere | 204/280 X |
| 4,529,486 | 7/1985 | Polan | 204/13 |

*Primary Examiner*—Donald R. Valentine
*Attorney, Agent, or Firm*—Zosan S. Soong

[57] ABSTRACT

There is disclosed an apparatus for depositing metal on a member comprising: (a) a first electrode comprising a first corrugated side; (b) a second electrode having the same polarity as the first electrode and comprising a second corrugated side, wherein the second corrugated side is disposed opposite the first corrugated side, and spaced therefrom; (c) a channel defined by the first corrugated side and the second corrugated side for movement of the member therebetween, wherein the channel has a plurality of alternating expansive areas and constrictive areas; and (d) a conveyor device for transporting the member through the channel.

9 Claims, 2 Drawing Sheets

APPARATUS FOR ELECTRODEPOSITION

BACKGROUND OF THE INVETION

This invention relates generally to a metal deposition cell and more particularly to anode electrodes of the metal deposition cell which have corrugated sides. The anodes and processes described herein are illustrated primarily in the context of an electroforming process, but the anodes are useful for other metal deposition processes including electroplating. The resulting electroformed articles are used for example as substrates in the fabrication of photoreceptors.

In electroforming cells employing two straight sided anodes, it is known that a mandrel moving through the channel defined by the anodes will experience varying current densities. The mandrel surface will experience varying current densities even if the mandrel were rotating. Non-uniform current densities tend to degrade the uniformity of the electroform thickness as well as the surface appearance of the electroform. The conventional response to the problem of varying current densities resulting from the use of straight sided anodes is to employ larger electroforming tanks to increase the mandrel to anode distance. However, the use of larger electroforming tanks requires more floor space, a larger quantity of bath components, and a higher voltage. There is therefore a need for a new anode design that allows the metal deposition process to occur at a smaller mandrel to anode distance which would decrease the size of the electroforming tank or apparatus. A smaller tank or cell reduces the amount of floor space, bath components, and/or voltage needed.

Various anode configurations and processes which employ these anodes are known:

Ashcroft, U.S. Pat. No. 1,545,383, discloses an electrolysis cell useful in connection with a process for the production of either zinc or lead by the reduction of the appropriate metal chloride. The anode and cathode surfaces of the electrodes of the cell may be corrugated to facilitate the flows of metal and chlorine in the cell. (See, e.g., page 3, lines 49–54).

Bailey et al., U.S. Pat. No. 3,844,906, discloses a process for maintaining a continuous and stable aqueous nickel sulfamate electroforming solution which employs an anode electrode in the form of an annular shaped basket.

Polan, U.S. Pat. No. 4,529,486, disclosed an arcuate shaped anode useful for the continuous electroforming of metal foil.

SUMMARY OF THE INVENTION

It is an object of the invention in embodiments to mitigate or eliminate the changes in the current densities experienced by a mandrel in the channel of the electroforming tank.

It is another object in embodiments to provide an electroforming apparatus and method which require a smaller anode to mandrel distance, as compared with conventional processes and apparatus, to reduce the size of the metal deposition tank, thereby minimizing the floor space, bath components, and voltage needed.

A further object is to provide a continuous process for depositing metal on a plurality of mandrels.

These objects and others are accomplished in embodiments by providing an apparatus for depositing metal on a member comprising:

(a) a first electrode comprising a first corrugated side;

(b) a second electrode having the same polarity as the first electrode and comprising a second corrugated side, wherein the second corrugated side is disposed opposite the first corrugated side, and spaced therefrom;

(c) a channel defined by the first corrugated side and the second corrugated side for movement of the member therebetween, wherein the channel has a plurality of alternating expansive areas and constrictive areas; and (d) a conveyor device for transporting the member through the channel.

BRIEF DESCRIPTION OF THE DRAWINGS

Other aspects of the present invention will become apparent as the following description proceeds and upon reference to the Figures which represent preferred embodiments.

The same reference numeral is used to designate the same or similar components in the Figures.

DETAILED DESCRIPTION

As used herein, the term corrugated refers to an undulating shape when viewing the electrodes from the top.

Figure 1:
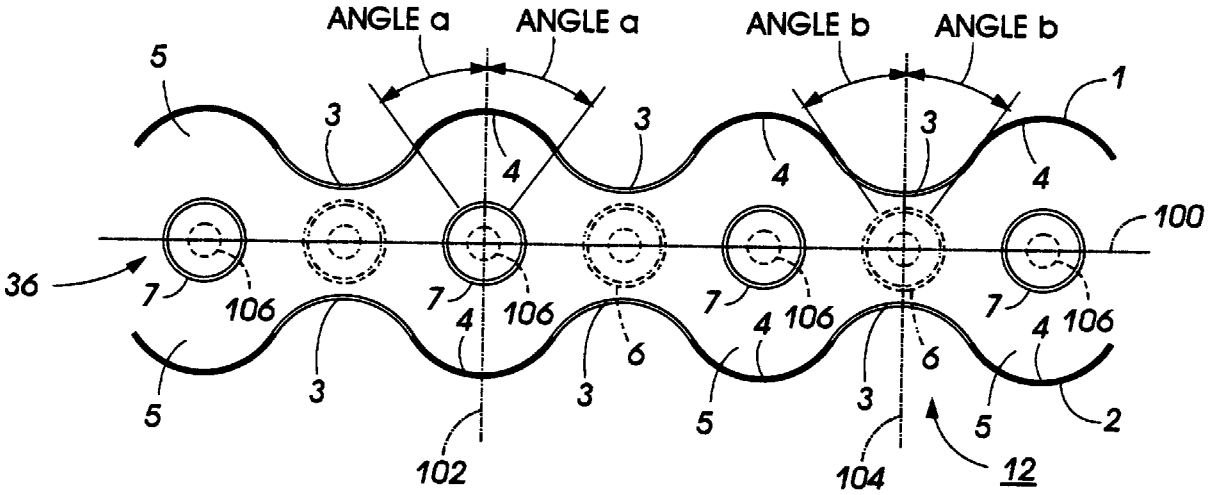
FIG. 1 depicts a schematic top view of an electroforming tank containing anodes of the present invention as configured for one electroforming line.

FIG. 1 discloses electroforming tank or cell 12 which comprises first anode 1 and second anode 2, each having a corrugated side formed by alternating constrictive ridges 3 (herein referred to as "ridges") and expansive grooves 4 (herein referred to as "grooves"). The corrugated sides of first anode 1 and second anode 2 are disposed opposite to one another and spaced apart, wherein the ridges of the first anode are preferably disposed directly opposite the ridges of the second anode and the grooves of the first anode are disposed directly opposite the grooves of the second anode. The phrase directly opposite means that the corrugated sides of the anodes are completely out of phase where the top view profile of the corrugated sides are analogous to waveforms. Where two waveforms are completely out of phase, the waveforms cancel one another in an interaction called destructive interference. The corrugated sides of the anodes can also be in an in phase configuration where the profiles of the corrugated sides are akin to two waveforms that are of the same frequency and that pass through corresponding values at the same instant. In embodiments, the corrugated sides of the anodes may have an out of phase configuration that falls somewhere between an in phase configuration and a completely out of phase configuration.

In FIG. 1, channel 36 is defined by the corrugated sides of first anode 1 and second anode 2. Mandrels or members 7 are linearly disposed in channel 36 to be subjected to the electroforming process. Mandrels 7 are conveyed through channel 36 by a conveyor device 106 which may be for example transporting arms or a conveyor belt. Channel 36 is comprised of a plurality of expansive areas 5, defined by grooves 4 of the two anodes, having generally greater anode to mandrel distance than constrictive areas 6, defined by ridges 3 of the two anodes, having generally lesser anode to mandrel distance. FIG. 1 depicts an expansive area at both the beginning and the end of the channel. However, in embodiments, a constrictive area may appear at the beginning and/or the end of the channel.

In embodiments of the present invention, the first anode 1 and the second anode 2 each includes a plurality of alternating electrically conductive regions (corresponding to grooves 4) and electrically nonconductive regions (corresponding to ridges 3). The length of each electrically conductive region in the anodes (1, 2) is determined by an angle a from line 102. Line 102 bisects groove 4 and is perpendicular to the longitudinal axis 100 that extends along the length of channel 36. Similarly, the length of each electrically nonconductive region in the anodes (1, 2) is determined by an angle b from line 104. Line 104 bisects ridge 3 and is perpendicular to the longitudinal axis 100. Angle a and angle b may range for example from about 10 to about 50 degrees, and preferably from about 20 to about 40 degrees. The electrically conductive regions contain electrically conductive material as described herein. The electrically nonconductive regions may be fabricated from for example rubber, plastic, or glass.

Figure 2:
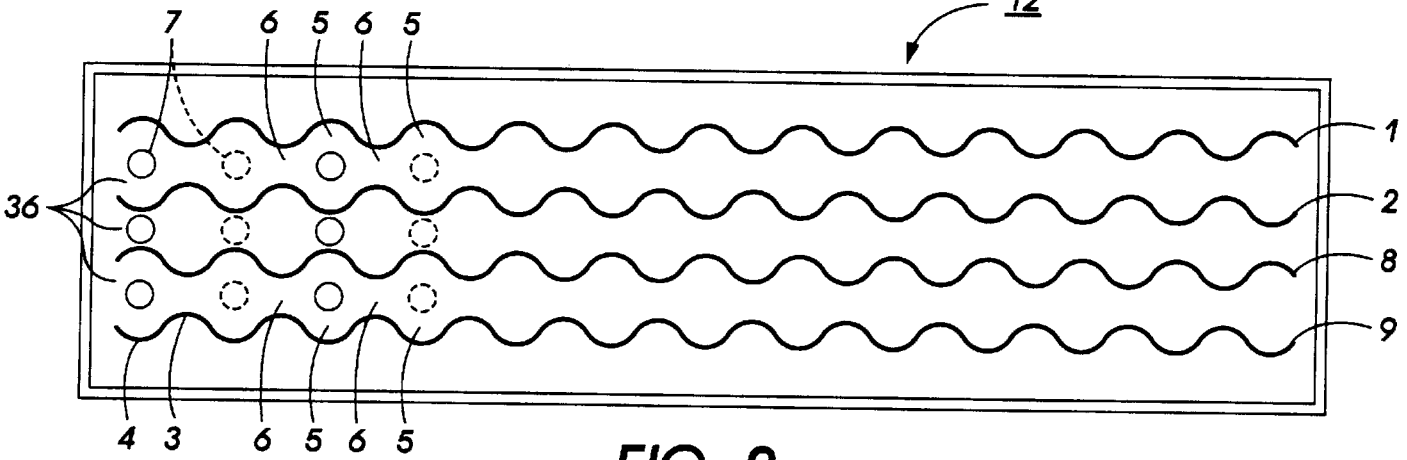
FIG. 2 depicts a schematic top view of an electroforming tank containing anodes of the present invention as configured for three electroforming lines.

FIG. 2 discloses electroforming tank or cell 12 which contains a plurality of anodes to electroform three lines of mandrels. Second anode 2 has two corrugated sides, the first faces a corrugated side of first anode 1 and the second faces a corrugated side of third anode 8. Third anode 8 has two corrugated sides, the first faces a corrugated side of second anode 2 and the second faces a corrugated side of fourth anode 9. Mandrels 7 are linearly disposed in the three channels 36. Mandrels 7 are conveyed through channels 36 by for example a conveyor device (not shown). The first electroforming line, defined between first anode 1 and second anode 2, the second electroforming line, defined between second anode 2 and third anode 3, and the third electroforming line, defined between third anode 3 and fourth anode 4, are arranged in a manner similar to that of the single electroforming line described above for FIG. 1. For example, the ridges and grooves of the various corrugated sides are disposed directly opposite the corresponding ridges and grooves of the opposing corrugated side. Each of the three channels 36 is comprised of expansive areas and constrictive areas as described in FIG. 1. For the two interior anodes (2, 8) of FIG. 2, preferably half the thickness of each anode is fabricated from an electrically conductive material and half is fabricated from an electrically nonconductive material, with the choice of orientation depending upon whether the groove or ridge of the opposing anode is conductive or nonconductive. This is needed because for example a region of anode 2 which may be considered a groove with respect to a anode 8 would be considered a ridge with respect to anode 1.

Although the electrode having the corrugated side can be the cathode and the mandrel can comprise the anode of the electroforming cell, the preferred configuration is where the electrode having the corrugated side comprises the anode and the mandrel comprises the cathode. The anode can have one corrugated side and one straight side, or both sides can be corrugated.

The top view profile of the corrugated sides of the anodes can be of any effective shape. The corrugated sides of the various anodes can have the same or different top view profile, and preferably are continuous, rather than segmented. Moreover, the individual ridges and grooves of each corrugated side may be the same or different from one another in shape and size. A preferred embodiment is where the ridges and grooves of the corrugated sides are in the form of semicircles. The radii of the ridges and grooves of the corrugated sides may be of any effective size, preferably ranging in size from about half the outer cross sectional dimension of the member to about eight times larger than half the outer cross sectional dimension of the member, more preferably ranging in size from about twice to about six times larger than half the outer cross sectional dimension of the member, and most preferably about four times larger than half the outer cross sectional dimension of the member. Illustrative sizes of the radii of the ridges and grooves of the corrugated sides range from about 1 cm to about 10 cm, and more preferably from about 2 cm to about 5 cm. The anodes may be of any suitable length, width, and height. For example, the anodes may have a length ranging from about 5 to about 200 ft, a width ranging from about 2 inches to about 2 ft, and a height ranging from about 5 inches to about 5 ft.

In embodiments, one or both of the anodes defining a channel, or portions of the anodes, are capable of movement towards one another, to narrow the channel, and/or movement away from one another, to widen the channel. Movement of the anodes, or portions thereof, may be effected manually or by any suitable mechanical and/or electronic apparatus. For example, the anodes may be mounted on tracks, where an electrical signal is is generated by the operator to a motor to effect anode movement. An advantage of movable anodes is that the deposition tank can accommodate different sized mandrels.

The anode may be fabricated from any suitable material and is of any effective design. In embodiments, the anode may be wholly or partially consumed in the metal deposition process by being fabricated from a material which is used to replenish the electrolytic bath to replace the metal being electrodeposited out of solution. However, it is preferred that the anode is fabricated from a material which is not consumed by the process. In such situations, the anode may be for example a basket containing a bath replenishment metal and is fabricated from a metal such as titanium which is typically not consumed in the metal deposition process. The basket may incorporate openings to permit flow of metal ions from the basket into the bath. The anode optionally contains a fabric anode bag made from a suitable material such as nap polyolefin to hold the bath replenishment metal.

The bath replenishment metal is typically the same metal used in the electroform. Preferred bath replenishment metals and electroform metals include nickel, especially sulfur depolarized nickel. The bath replenishment metal may be in any suitable form or configuration. Typical forms include buttons, chips, squares, and strips.

The channel defined by the anodes may be of any appropriate width and length for a metal deposition process. The width varies between a minimum distance, defined between the ridges of opposing anodes, and a maximum distance, defined between the grooves of opposing anodes. For example, the minimum distance may range in size from greater than the outer cross sectional dimension of the member to about eight times the cross sectional dimension of the member. Illustrative minimum distances may be from about 5 cm to about 50 cm. The maximum distance may range in size, for example, from twice to about twelve times the cross sectional dimension of the member. Illustrative maximum distances may be from about 10 cm to about 100 cm. The channel may be the same length as the length of the anodes. In embodiments, the channel has a length ranging from about 5 to about 200 ft.

The expansive areas of the channel, defined by the grooves of the anodes, are regions of higher current density, wherein the higher current density ranges for example from about 80 to about 600 amperes per square foot, and more preferably from about 100 to about 300 amperes per square foot. The constrictive areas of the channel, defined by the ridges of the anodes, are regions of lower current density, wherein the lower current density ranges for example from about 0 to about 75 amperes per square foot, and more preferably from about 25 to about 50 amperes per square foot. The total number of higher and lower current density regions in each channel may be any effective number to deposit a relatively uniform coating of metal on the mandrel, preferably ranging from about 4 to about 30 regions, and more preferably ranging from about 10 to about 20 regions.

By providing rhythmic variations in anode to mandrel distances, which result in alternating regions of higher and lower current densities, the fluctuations in current density experienced by the mandrel during passage through the channel is mitigated or eliminated. It is believed that the average current density experienced by a unit area of the mandrel will be the same as other unit areas of the mandrel during passage through the channel despite fluctuations in the current density.

The mandrels may be moved through the different cells of the metal deposition cycle such as the preheat, the metal deposition tank, the solution recovery, and the cooling by any suitable apparatus including transporting arms or a conveyor belt, preferably continuous, employed in conjunction with a cam to move the coated or uncoated mandrels up, down, and through the various cells. The mandrels or members are conveyed linearly through the channel defined by the anodes at an effective speed, which preferably ranges from about 1 to about 6 mm per second. The mandrels may be optionally rotated at an effective speed during transport through the channel, wherein the rotation speed preferably ranges from about 5 to about 20 revolutions per minute.

The metal deposited on the mandrel may be of an effective thickness, and preferably ranges from about 1 mm to about 3 cm in thickness. The formed article may be of any suitable shape including a cylinder and an endless belt. The formed article preferably is ductile, electrically conductive, and seamless, with a relatively high tensile strength of from about 90,000 to about 130,000 psi, and a ductility of between about 3 to 12%. In order to be suitable for use as the substrate for the image retention surface in an electrostatographic apparatus, it is important that the formed article exhibits a high degree of thickness uniformity and a controlled degree of surface roughness. Generally, the surface roughness exhibited by the formed article ranges from about 10 to 80 microinches, RMS, and preferably, from about 30 to 50 microinches, RMS.

The mandrel or member may be of any effective design and configuration, and preferably has a cylindrical shape. Suitable mandrels are illustrated in Herbert et al., U.S. Pat. No. 4,902,386, the disclosure of which is totally incorporated by reference. Preferred mandrels have the following dimensions: a length ranging from about 5 inches to about 5 feet; and an outside cross sectional dimension ranging from about 3 inches to about 4 feet.

Figure 3:
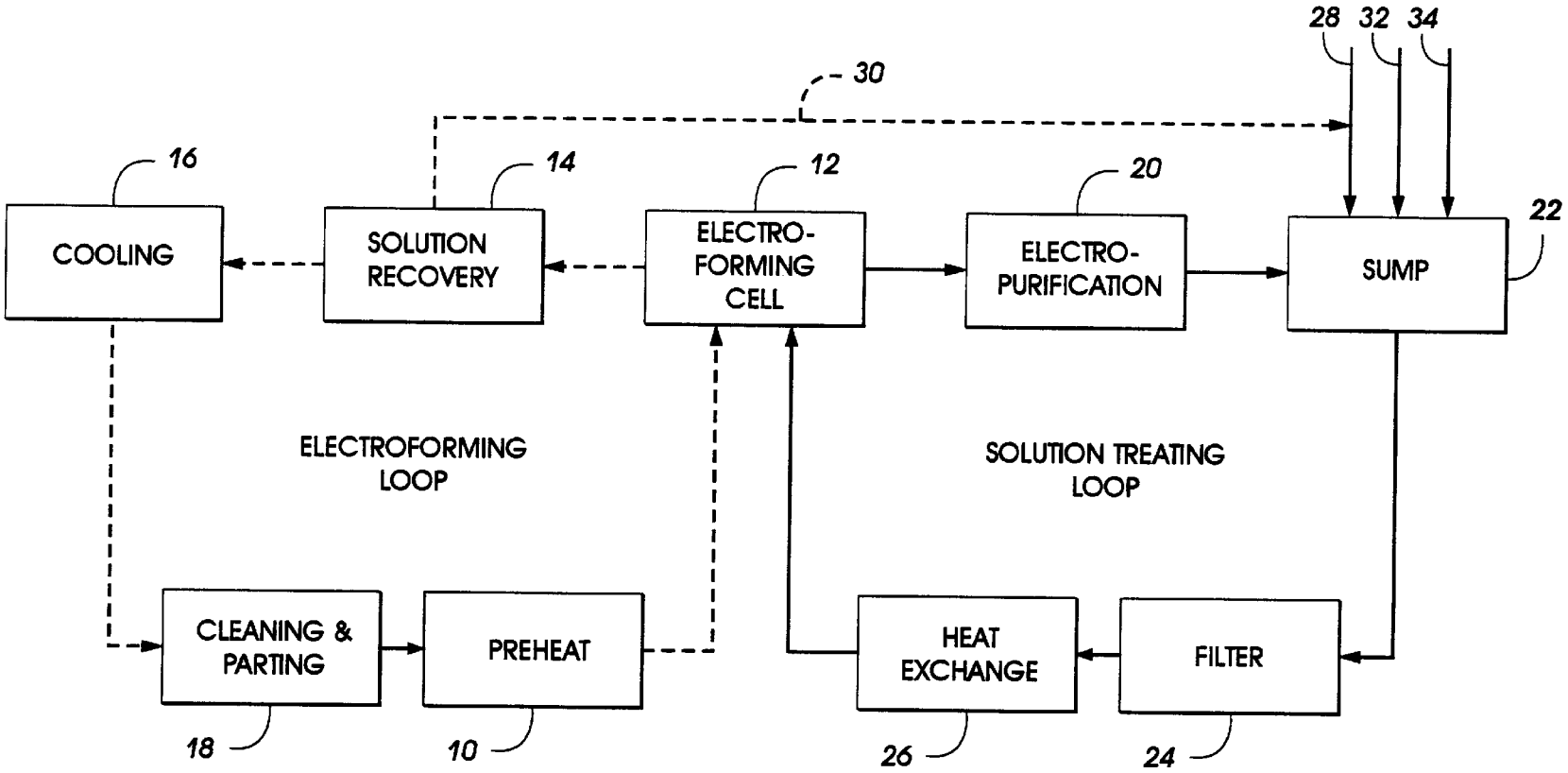
FIG. 3 depicts a schematic flow diagram illustrating a typical electroforming loop and an electroforming solution treating loop.

In FIG. 3, an article such as a cylinder or a belt is electroformed by preheating an electrically conductive mandrel, such as a mandrel having an aluminum core and a polished defect free chromium coating, at a preheating station 10. Preheating is effected by contacting the mandrel with an electroforming solution at an effective temperature such as about 15020 F. for a sufficient period of time to bring the mandrel to about 150° F. Preheating in this manner allows the mandrel to expand to the dimensions desired in the electroforming zone 12 and enables the electroforming operation to begin as soon as the mandrel is placed in the electroforming zone 12. Thereafter, the mandrel is transported from preheating station 10 to an electroforming zone 12, which is described herein and is illustrated by FIGS. 1 and 2.

Upon completion of the electroforming process, the mandrel and the article formed thereon are transferred to an electroforming solution recovery zone 14. Within this zone, a major portion of the electroforming solution dragged out of the electroforming cell is recovered from the formed article and the mandrel. Thereafter, the mandrel and the article formed thereon are transferred to a cooling zone 16 containing for example water maintained at an effective temperature such as about 60° to about 75° F. or cooler for cooling the mandrel and the article, whereby the article, which preferably exhibits a different coefficient of thermal expansion than the mandrel, can be readily separated from the mandrel. After cooling, the mandrel and article are passed to a parting and cleaning station 18 at which the article is removed from the mandrel, sprayed with water and subsequently passed to a drier (not shown). The mandrel is sprayed with water and checked for cleanliness before being recycled to preheat station 10 to commence another electroforming cycle.

The temperature of the electroforming or plating solution may be between about 100° and 160° F. and preferably is between about 135° and 160° F. Current density supplied by a DC source is about 20 to 600 amperes per square foot of mandrel surface.

Because of the significant effects of both temperature and solution composition on the final product, it is preferred to maintain the electroforming solution in a constant state of agitation thereby substantially precluding localized hot or cold spots, stratification and inhomogeneity in composition. Agitation may be obtained by continuous rotation of the mandrel and by impingement of the solution upon the mandrel and cell walls as the solution is circulated through the system. Generally, the solution flow rate across the mandrel surface can range from about 4 to 10 linear feet/second. For example, at a current density of about 300 amps/ft$^2$ with a desired solution temperature range within the cell of about 150° to 160° F., a flow rate of about 15 gal/min of solution may be sufficient to effect proper temperature control. The combined effect of mandrel rotation and solution impingement may assure uniformity of composition and temperature of the electroforming solution within the electroforming cell.

A preferred electroforming or plating solution is as follows:

Total Deposition Metal (such as nickel): 12.0 to 15.0 oz/gal (the recited concentration for the Total Deposition Metal refers to the metal alone without any counterions and does not include the metal component of the halide compound disclosed herein as $MX_2.6H_2O$);

Deposition Metal (M Halide (X) as $MX_2.6H_2O$: 0.11 to 0.23 moles/gal, where M is a metal such as nickel, and X is a halogen such as fluorine, chlorine, iodine, and bromine; and Buffering Agent (such as $H_3BO_3$): 4.5 to 6.0 oz/gal.

Optionally, there is continuously charged to said solution about 1.0 to $2.0\times10^{-4}$ moles of a stress reducing agent per mole of deposition metal electrolytically deposited from the solution. The metal halide may be any suitable compound typically used in electroforming solutions preferably nickel chloride, nickel bromide, and nickel fluoride.

For continuous, stable operation with high throughput and high yield of acceptable electroformed articles, a nickel sulfamate solution is preferred and is maintained at an equilibrium composition within the electroforming zone. The preferred nickel sulfamate solution comprises:

Total Nickel: 13.5 to 14.0 oz/gal;

Chloride as $NiCl_2.6H_2O$: 1.6 to 1.7 oz/gal;

$H_3BO_3$: 5.0 to 5.4 oz/gal;

Weight Ratio (Chloride as $NiCl_2.6H_2O$)/Total Nickel: 0.12±0.02;

pH: 3.8 to 4.1; and

Surface Tension: 33 to 37 dynes/cm$^2$.

Additionally, from about 1.3 to $1.6\times10^{-4}$ moles of a stress reducing agent per mole of nickel electrolytically deposited from said solution is continuously charged to said electroforming solution.

Suitable stress reduction agents are sodium sulfobenzimide (saccharin), 2-methylbenzenesulfonamide, benzene sulfomate, naphthalene trisulfomate, and mixtures thereof.

It has been found that the pH can be essentially maintained within the range set forth above by maintaining a steady state concentration of buffering agent in the solution, generally boric acid ($H_3BO_3$), within the range of 5.0 to 5.4 oz/gal.

Control of the surface tension of the electroforming solution may be necessary in order to substantially reduce surface flaws, especially pitting in the electroformed article. The surface tension of the solution preferably ranges from about 33 to about 37 dynes/cm$^2$ in order to assure a high rate of production with minimum rejects because of surface flaws. The surface tension of the solution can be maintained within this range by maintaining a steady state concentration of an anionic surfactant such as sodium lauryl sulfate, Duponol 80, a sodium alcohol sulfate, Petrowet R, a sodium hydrocarbon sulfonate (said latter two surfactants being available from E. I. du Pont de Nemours & Co., Inc.), and the like, ranging from 0 to 0.014 oz/gal within the solution, and preferably, by maintaining a steady state concentration of from 0 to 0.007 oz/gal of surfactant therein.

To maintain a continuous steady state operation the electroforming solution is continuously circulated through a closed solution treating loop as shown in FIG. 3. This loop comprises a series of processing stations which maintain a steady state composition of the solution, regulate the temperature of the solution and remove any impurities therefrom, thereby assuring the required conditions within the electroforming cell 12.

The electroforming cell 12 contains one wall thereof which is shorter than the others and acts as a weir over which the electroforming solution continuously overflows into a trough as recirculating solution is continuously pumped into the cell via the solution distributor manifold or sparger along the bottom of the cell. The solution flows from the electroforming cell 12 via a trough to an electropurification zone 20 and a solution sump 22. The solution is then pumped to a filtration zone 24 and to a heat exchange station 26 and is then recycled in purified condition at a desired temperature and composition to the electroplating cell 12 whereupon admixture with the solution contained therein, the steady state conditions set forth above are maintained on a continuous and stable basis.

The electrolytic purification station 20 is provided for removing dissolved metallic impurities from the electroforming solution prior to filtering. A metal plate of steel or preferably, stainless steel, can be mounted in station 20 to function as the cathode electrode. Anodes can be provided by a plurality of anode baskets which comprise tubular shaped metallic bodies, preferably titanium, each having a fabric anode bag. A DC potential is applied between the cathodes and the anodes of the purification station from a DC source. The electropurification station 20 includes a wall thereof which extends coextensively with a wall of the solution sump zone 22 and functions as a weir. The electroforming solution flows from electropurification zone 20 into the solution sump zone 22 via this weir.

The quantity of electroforming solution circulated within the closed loop described herein is maintained relatively constant. Replenishment of solution which is carried away by the mandrel when removed from the electroforming cell and water which is lost through evaporation is provided. The solution can be replenished by the automatic addition of de-ionized water from a source 28 and/or by recycling solution from the rinse zone 14 to sump 22 via line 30. Sensors can be positioned in sump 22 adapted for automatically signaling a low level of solution therein and causing the operation of pumps which pump de-ionized water and/or rinse solution to sump 22. Additionally, a pH meter can be positioned in sump 22 for sensing the pH of the solution and for effecting the addition of an acid such as sulfamic acid when necessary to maintain essentially constant pH. The continuous addition of stress reducing agents as described hereinabove can be effected at sump 22 via line 32. Also, control of the surface tension of the solution can be maintained by continuous addition of surfactant to the sump via line 34. In this manner, all component additions or make up are made at the sump 22 thereby enabling maintenance of a homogeneous solution at a steady state equilibrium composition within the electroforming cell 12.

The solution which has been electrolytically purified can contain undissolved micron sized solids and sludge from the anodic dissolution of the deposition metal which must be removed prior to return to the electroforming cell 12. This solution is pumped from the sump tank 22 to a filter station 24 which removes essentially all of the undissolved solids from the solution.

As indicated herein, the temperature of the electroforming solution must be maintained within a desired range in order to provide a desired surface smoothness and uniformity in the electroformed belt. The electroforming solution which flows from the cell is raised in temperature due to the flow of relatively large currents therein and accompanying generation of heat in the electroforming cell. Means are provided at the heat exchanging station 26 for cooling the electroforming solution to a lower temperature. The heat exchanger can be of conventional design and receives a coolant such as chilled water from a cooling or refrigerating system (not shown). The electroplating solution which is cooled in the heat exchanger means can be successively pumped to a second heat exchanger which provides for increasing the temperature of the cooled solution to within relatively close limits of the desired temperature. The second heat exchanger can be steam heated by steam derived from a steam generator (not illustrated). The first cooling heat exchanger can, for example, cool the relatively warm solution from a temperature of 150° F. or above to a temperature of about 140° F. The second warming heat exchanger will heat the solution to a temperature of 140° F. plus or minus 2° F. In addition, the heat exchange station 26 is provided for heating the solution to the operating temperatures on startup of the system and upon the addition of replenishment solution to the system. The efflux from the heat exchange station 26 is pumped to the electroforming cell 12 where, upon admixture with the solution present within the cell, steady state conditions of both composition and temperature are maintained on a continuous basis.

Further details of the electroforming solution, apparatus, and methods are illustrated in Bailey et al., U.S. Pat. No. 3,844,906 and Wallin et al., U.S. Pat. No. 3,876,510, the disclosures of which are totally incorporated by reference.

Other modifications of the present invention may occur to those skilled in the art based upon a reading of the present disclosure and these modifications are intended to be included within the scope of the present invention.

We claim:

1. An apparatus for depositing metal on a member comprising:

(a) a first electrode comprising a first corrugated side having ridges and grooves;

(b) a second electrode having the same polarity as the first electrode and comprising a second corrugated side having ridges and grooves, wherein the second corrugated side is disposed opposite the first corrugated side, and spaced therefrom;

(c) a channel defined by the first corrugated side and the second corrugated side for movement of the member therebetween, wherein the channel has a plurality of alternating expansive areas and constrictive areas; and (d) a conveyor device for transporting the member through the channel wherein the ridges of the second corrugated side are disposed directly opposite the ridges of the first corrugated side and the grooves of the second corrugated side are disposed directly opposite the grooves of the first corrugated side.

2. The apparatus of claim 1, wherein the first electrode and the second electrode each comprises a plurality of alternating electrically conductive regions and electrically nonconductive regions.

3. The apparatus of claim 2, further comprising a rotation device for rotating the member during its movement through the channel.

4. The apparatus of claim 1, wherein the first corrugated side and the second corrugated side have the same or different top view profile.

5. The apparatus of claim 1, wherein the ridges and grooves of the first corrugated side and the second corrugated side are in the form of semicircles.

6. The apparatus of claim 5, wherein when the member is present the radii of the ridges and grooves of the first corrugated side and the second corrugated side range in size from about half the outer cross sectional dimension of the member to about eight times larger than half the outer cross sectional dimension of the member.

7. The apparatus of claim 5, wherein when the member is present the radii of the ridges and grooves of the first corrugated side and the second corrugated side range in size from about twice to about six times larger than half the outer cross sectional dimension of the member.

8. The apparatus of claim 1, wherein when the member is present the minimum distance between the first corrugated side and the second corrugated side ranges in size from greater than the outer cross sectional dimension of the member to about eight times the outer cross sectional dimension of the member.

9. The apparatus of claim 1, wherein the channel comprises a plurality of alternating higher and lower current density regions, wherein the current density of the higher current density regions ranges from about 80 to about 600 amperes per square foot, and the current density of the lower current density regions ranges from 0 to about 75 amperes per square foot.

* * * * *